United States Patent [19]

Watson et al.

[11] 4,159,109

[45] Jun. 26, 1979

[54] METHOD AND APPARATUS FOR DETECTING JAM-UPS OF SERIALLY ADVANCING BLANKS

[75] Inventors: Raymond S. Watson, Baltimore, Md.; Jack A. Wohlfeil, Fond du Lac, Wis.

[73] Assignee: The Ward Machinery Company, Cockeysville, Md.

[21] Appl. No.: 854,542

[22] Filed: Nov. 25, 1977

[51] Int. Cl.[2] ..... B65H 7/02

[52] U.S. Cl. ..... 271/259

[58] Field of Search ..... 271/258, 259, 263, 265

[56] References Cited

U.S. PATENT DOCUMENTS

| | | | |
|---|---|---|---|
| 3,026,419 | 3/1962 | Aweida | 271/263 X |
| 3,150,873 | 9/1964 | MacGregor | 271/259 |
| 3,825,251 | 7/1974 | Beery | 271/258 |

*Primary Examiner*—Richard A. Schacher
*Attorney, Agent, or Firm*—Boyce C. Dent

[57] ABSTRACT

A method and apparatus for detecting jam-ups of serially advancing blanks of which the method comprises storing a number corresponding to the length of the blanks in predetermined increments, detecting a leading edge of such blanks, actuating a control means by the detection of the leading edges which generates a digit corresponding to the predetermined increments, detecting a trailing edge of such blanks to deactuate the control means, comparing the stored number with the digits generated by the control means, and stopping the blanks when the number of digits exceeds the stored number. Apparatus for carrying out the foregoing method preferably includes a storage circuit for the number corresponding to the blank length, a detector for detecting the leading and trailing edges of the blanks, a control means responsive to the detector for generating and storing digits corresponding to the blank length passing the detector, and a comparison circuit to determine when the number of digits exceeds the stored number and stopping the advance of blanks when this occurs.

8 Claims, 2 Drawing Figures

METHOD AND APPARATUS FOR DETECTING JAM-UPS OF SERIALLY ADVANCING BLANKS

BACKGROUND OF THE INVENTION

1. Field of the Invention

This invention relates generally to serially advancing articles and more particularly to a method and apparatus for detecting jam-ups of such advancing articles and stopping the advancement thereof in response to detection of a jam-up.

2. Brief Description of the Prior Art

In the manufacture of paperboard blanks for making finished boxes therefrom, it is customary to advance the flat blanks from a printing and slotting or diecutting machine through a folder-gluer machine which applies adhesive to one edge thereof and folds the blank along score lines therein to form flat tubular carton blanks which may be stacked and tied into bundles for shipment. An example of such a folder-gluer machine may be found in Lopez U.S. Pat. No. 3,122,069. Jam-ups of blanks frequently occur in such machines due to imperfect score lines, blank slippage and the like. Often such jam-ups go undetected until several blanks become jammed in the machine and which may take several minutes of production time to clear and sometimes damages the machinery. Accordingly, it is beneficial to have a detection system to detect such jam-ups and stop the machine before many blanks become jammed and even to detect an impending jam.

Many efforts have been made to provide a jam detection system suitable for operation with modern, fast-moving machinery. One notable example is found in King U.S. Pat. No. 3,311,224 which measures the spaces between the advancing blanks and stops the machine if the spaces become too short indicating that a jam is about to or has occurred. Unfortunately, this system depends on the space between blanks being constant for all sizes of blanks whereas most box making machinery is adjustable to cyclically feed different size blanks within a preset range. The nature of the feeding cycle results in a greater spacing between blanks when the blank size is shorter than the maximum size that can be processed by the machine. Thus, the system devised by King does not appear capable of detecting jams when the space between blanks is not constant for all blank sizes. The Grover and Broido patents mentioned in the King patent are of interest with respect to other systems for detecting jams. The patents cited in the prosecution of the King patent are of interest only insofar as they illustrate various isolated elements that might be combined for specific purposes.

Accordingly, it is an object generally of the present invention to provide a system for detecting jam-ups of serially advancing blanks and more particularly for detecting actual or impending jams independently of the size of the spaces between blanks or the length of such blanks being run.

SUMMARY OF THE INVENTION

The objects of the present invention are generally accomplished by storing a number in a storage circuit that corresponds to the length of the blank being processed in predetermined increments, detecting the leading and trailing edges of the advancing blanks with a photocell, actuating and deactuating a rotatable shaft encoder in a control circuit by the passage of the leading and trailing edges of the blanks past the photocell to generate a number of digits corresponding to the length of the blanks in increments passing the photocell, comparing the number of digits, stored in a counter circuit, to the number stored in the storage circuit, and stopping the advance of the blanks when the number of digits exceeds the stored number. In essence, this system looks at the blank length, such as may be dialed in by an operator, and at the actual length of the blank passing the photocell, as determined by actuation and deactuation of the shaft encoder, and, if a succeeding blank is closely adjacent to the preceding blank so as to indicate a blank of excessive length (as measured by the photocell/encoder circuit), then it stops the advancing blanks by a stop circuit arranged to stop the machine.

The above and further objects and novel features of the invention may be more fully understood by reference to the drawings and the following detailed description. It should be understood, however, that the drawings are for reference only and are not to be construed as a definition of the invention.

BRIEF DESCRIPTION OF THE DRAWINGS

In the drawings wherein like parts are marked alike.

DESCRIPTION OF THE PREFERRED EMBODIMENT

Figure 1:
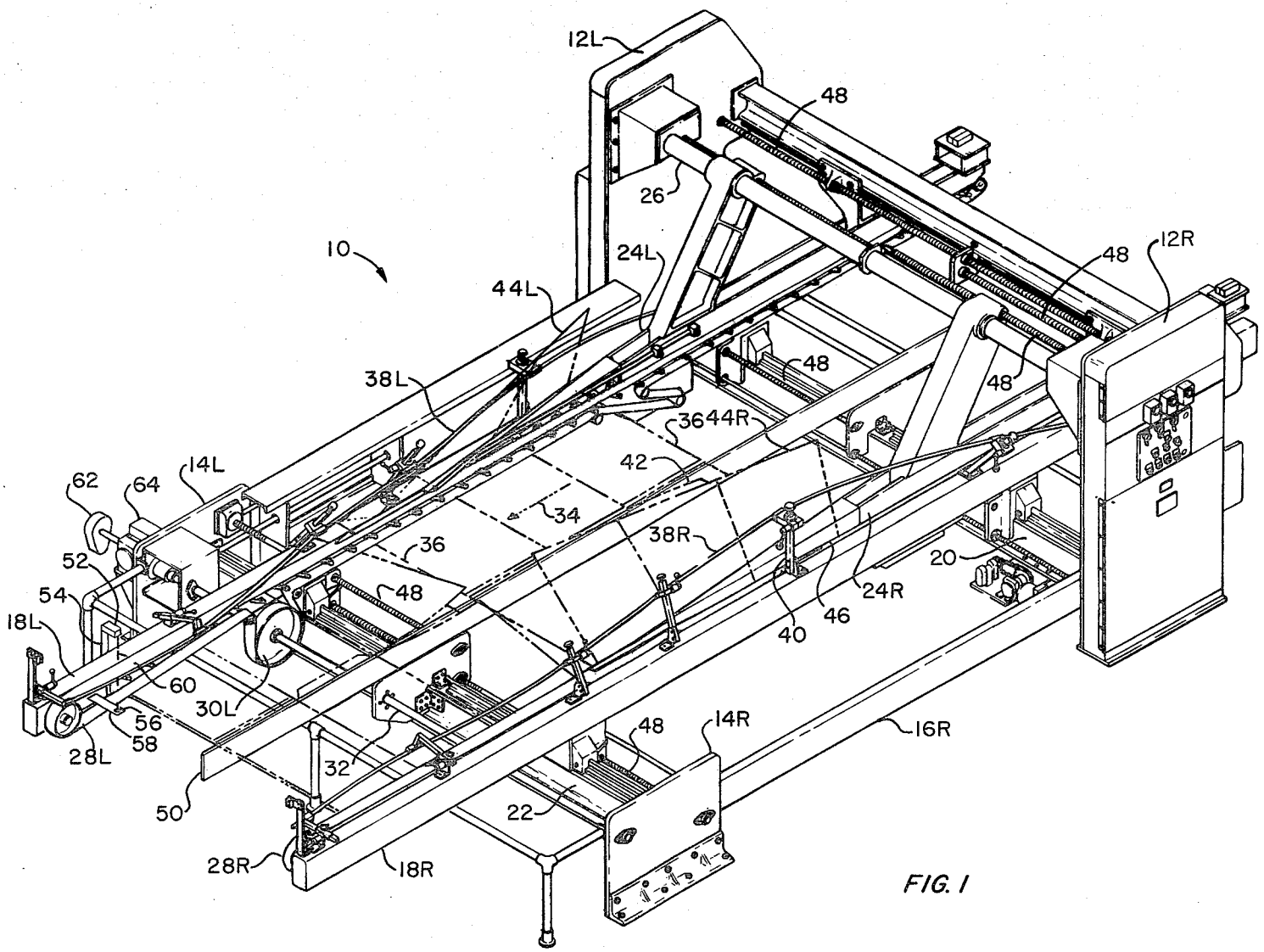
FIG. 1 is an isometric view of a folder-gluer machine showing the advance of blanks therethrough (blanks shown in phantom lines so as not to obscure the machine), the location of the photocell for detecting passage of the blanks, and the location of the shaft encoder.

Referring now to FIG. 1, the present invention is used in connection with a substantially conventional folder-gluer machine, generally denoted by numeral 10, similar to the one shown and described in the aforementioned Lopez patent. Briefly, folder-gluer 10 includes a pair of upstream side frames 12R and 12L and smaller downstream side frames 14R and 14L connected by bracing and alignment members 16R and 16L (16L not shown since it is obscured by other parts of the apparatus). A pair of lower folding rails 18R and 18L are supported on an upstream guideway 20 and a downstream guideway 22, both of which extend laterally between their respective side frames. A pair of upper folding rails 24R and 24L are supported on an upstream guideway 26 which extends laterally between side frames 12R and 12L. A pair of conveyor belts 28R and 28L are mounted for rotation on the inboard side of the respective lower folding rails, as best illustrated by the belt 28L on rail 18L. The belts 28R and 28L are driven by drive pulleys 30R and 30L (30R obscured from view) which are mounted for driving rotation on drive shaft 32. A jackshaft (not shown) is connected to drive shaft 32 along the left side of the machine. The jackshaft customarily is connected to an upstream box machine (not shown) that is immediately adjacent to the upstream end of the folder-gluer 10; the box machine is driven by a main drive motor (not shown) and thereby drives the folder-gluer 10 by the arrangement just described. The belts 28R and 28L are arranged so that their upper flights travel in the downstream direction as indicated by arrow 34; these belts serve to serially advance a succession of box blanks 36 (of which two are shown by phantom lines so as not to obscure the apparatus) through the folder 10 in which two panels of the blanks are folded as will be described.

A pair of upper folding rods 38R and 38L are supported on the lower folding rails 18R and 18L by a number of supports of which one is denoted by numeral 40, the remainder being substantially identical.

The blanks 36 to be folded enter the upstream end of the folder 10 in a flat, open condition and are advanced therethrough by the belts 28R and 28L. As the blanks 36 enter the folder 10, adhesive is applied to a glue tab 42 on the blanks 26 (glue applicator obscured by side frame 12R). Thereafter, the blanks 26 advance downstream; as they do, the side panels 44R and 44L are folded towards one another by being folded about score lines 46 therein, such score lines being in alignment with the lower outer edge of the upper folding rails 24R and 24L. Folding of the panels is accomplished by having the panels 44R and 44L ride against the folding rods 38R and 38L which are curved, as shown, to cause the panels to rise from their original horizontal position to the upright position as shown on the first blank 36 and then over the center portion of the blank as shown on the second of the blanks shown. The supports 40 are adjustable in an arc about their base and the rods 38R and 38L are flexible (preferably being made of Nylon) so that the rods may be curved to cause one panel to fold slightly before the other so that the panel with the glue tab 42 can be selectively folded to be on top of or beneath the other panel, depending on which arrangement is desired. The rods are also adjustable in curvature to suit the length of the box blank being run.

The lower folding rails 18R and 18L, which also support the folding rods 38R and 38L and conveyor belts 28R and 28L, are adjustable toward and away from the lateral center of the folder 10 to position them for alignment with the score lines 46 in the blanks being processed, it being understood that the aforementioned box machine is capable of processing blanks of different sizes. The upper folding rails 24R and 24L are likewise adjustable for the same reason. Adjustment of these members is accomplished by the use of motorized screw shafts 48 passing through conventional ball nuts in the supports for such members. The screw shafts are all denoted by numeral 48 for the purposes of this description although they are different with respect to length, location, and the side of the machine from which they are driven. In addition, it is not deemed necessary to identify the individual supports for the various rails since their location and function are readily apparent from FIG. 1. It should also be noted that a center support member 50 is used to support the center of the advancing blanks 36 to prevent them from buckling downward under their own weight. This support is not adjustable, always remaining in the lateral center of the machine.

It should be observed on FIG. 1 that a photocell 52 is mounted to the lower folding rail 18L by a support bracket 54 near the downstream end of the folding rail. A reflector 56 is mounted on a support bracket 58 which is also secured to the folding rail 18L at the position shown. The arrangement is such that a light beam 60 emitted by the photocell 52 passes downward across the path of travel of the blanks 36 inboard of the conveyor belt 28L and is reflected back to a receiver portion of the photocell 52 when the spaces between the blanks are present in the area of the light beam 60. However, when a blank crosses the light beam, it blocks the reflector and the beam 60 is not received by the photocell 52. The result of the interruption of the light beam 60 will be explained later.

A shaft encoder 62 is mounted to the end of drive shaft 32. It is preferably close mounted to a gear box 64 connected to the end of drive shaft 32 but is shown extended away from the gear box 64 for purposes of explanation. A shaft encoder satisfactory for the purposes of the present invention is one manufactured by The Singer Company, Kearfott Div., 1150 McBride Ave., Little Falls, N.J. 07424, item identification number 05088-CR-41095031 which is arranged to produce an electrical pulse signal for each tenth of an inch of the circumference of the printing die cylinder in the box machine (not shown) that precedes the folder 10. The function of such signals will be explained later.

As previously mentioned, the box machine (not shown) that precedes the folder 10 is capable of processing blanks of different sizes including different lengths with respect to the path of travel of the blanks. Such box machines feed the blanks at cyclic intervals because the printing and slotting performed on the blanks must remain in register with the blanks as well understood by those skilled in the art. However, because of this cycle feeding, the spaces between the advancing blanks is dependent upon the length of the blank. For example, if the box machine is nominally a 50 inch (1270.0mm) machine (meaning that the circumference of the printing die cylinder therein has a 50 inch circumference), the maximum length blank that can be processed is about 49 inches (1244.6mm) since it has been found that the blanks cannot be fed and processed in abutting relationship. Thus, when 49 inch blanks are processed, a 1 inch (25.4mm) space will occur between the blanks 36; similarly, if a 45 inch (1143.0mm) blank is processed, the space between the blanks will be about 5 inches (127.0mm). This relationship holds true throughout the range of blank sizes from maximum to minimum. However, it should be understood that once the blanks leave the box machine and enter the folder 10, there is less control of the position of the blanks along their path of travel; that is, some slippage between the blanks 36 and the conveyor belts 28R and 28L may occur, especially due to the friction between the folding rods 38R and 38L which may also cause minor skewing of the blanks because one side panel thereof is being folded ahead of the other. The net result is that the spacing between blanks does not remain constant whereas the length of the blank will be constant. Thus, the length of the blanks provides a precise distance that can be more easily measured and used than the spacing between the blanks.

Jam-up of the advancing blanks 36 in folder 10 may occur for different reasons such as from improperly formed score lines formed by the preceding box machine, from pieces of scrap paperboard being carried along by the blanks, friction between the blanks and the folding elements, and difficulties encountered by entry into adjacent downstream processing equipment such as a counter-ejector machine (not shown). Actually, most jam-ups occur near the downstream end of the folder and therefore the photocell 52 has been shown in that area although it may be placed at other areas along the length of the machine. Regardless of the cause of such jams, they usually take the form of one blank being abutted against the preceding blank or a number of blanks becoming shingled on top of each other. This interferes with operation of the machine, often damages the blanks, and sometimes damages the equipment.

Therefore, if a jam can be detected quickly, it can become cleared quickly because fewer blanks are involved; in addition, fewer blanks will be damaged and there is less likelihood that the equipment will be damaged.

The jam detector of the present invention encompasses a method and apparatus for detecting jam-ups of the box blanks 36 advancing serially through the folder-gluer 10. The method comprises storing a number corresponding to the actual blank length and comparing it to a number representing the measured length of the blank as it passes through the folder 10; if the latter number exceeds the first stored number, it is an indication that a blank has stayed too long in one location or that the blanks are so close together (even shingled) so as to appear as one blank. Thus, when the measured number exceeds the stored number, a signal is provided to automatically stop the machine. In addition, to preventing the jam-up from compounding, it signifies to the machine operator that a jam-up has occurred and he can then clear it.

The method comprises, in greater detail, first storing a number corresponding to the actual length of the blanks in predetermined increments such as in tenths of an inch (2.54mm). Next, the length of the blank is measured as it passes through the folder 10; this is accomplished by detecting the leading edge of each blank and, in response thereto, actuating a control circuit which generates one digit for each of the measured increments of length of the blank; then, detecting the trailing edge of blank which stops or deactuates the control circuit from producing such digits; comparing the stored number to the number of digits corresponding to the measured length of the blank; and, if the number of digits exceeds the stored number (which indicates that one blank has stayed in a position too long thereby indicating a jam is likely to occur or indicates that a jam has actually occurred), stopping the advance of the blanks.

Detecting the leading and trailing edges of the blanks is preferably achieved by directing a beam of energy into the path of advance of the blanks, such as by the photocell 52 previously described, which is interrupted by the passage of a blank and resumes when the trailing edge of the blank passes. Thus, the leading edge of the blank causes the photocell to generate a signal to actuate the aforementioned control circuit from the interruption of the light beam and the trailing edge causes the photocell to generate another signal from resumption of the light beam to deactuate the control circuit. It should be understood that such signals need only be a raising or lowering of the voltage level produced by the photocell during the time that it is interrupted by a blank; nevertheless, the net effect is that two signals are provided.

Actuating the control means preferably comprises producing an encoder signal for each of the predetermined length increments from a rotating shaft encoder, such as the encoder 62 shown in FIG. 1, while the control means is actuated by the signal from the photocell 52 and advancing an electronic counter one digit for each of the encoder signals. This provides a digit for each incremental length which can be compared to the prestored number which may also be in the form of digits.

Figure 2:
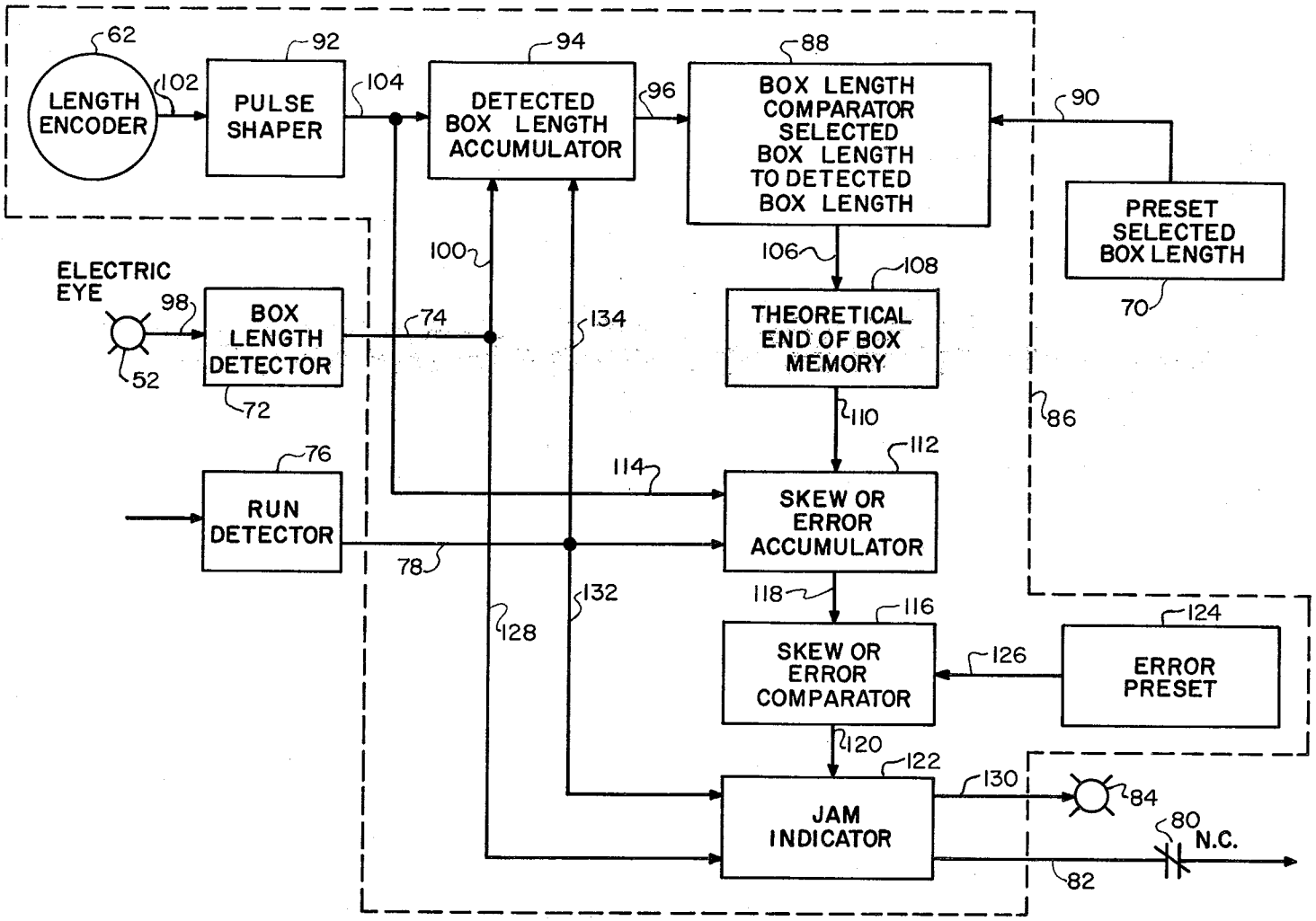
FIG. 2 is a block diagram of the invention illustrating the basic elements of the detector system.

The apparatus that can be used for performing the foregoing method is shown in the block diagram of FIG. 2. It is not believed necessary to show the actual circuitry and components of the various block diagram units since an electrical engineer skilled in the art can easily produce the necessary circuits by following the desired functions of the units as will be hereinafter described. In addition, the actual circuits need not conform to any particular arrangement so long as they produce the desired outputs in response to the inputs provided and no special components are needed that are not readily commercially available.

The means for storing a number corresponding to actual blank length is shown by the block labeled "preset selected box length" and denoted by numeral 70. This unit may consist simply of conventional thumbwheel digit switches to dial in the actual length of the blank being run in inches and tenths of inches to provide a means for entering the length of the blanks in predetermined increments into storage as will be explained. Preferably, the unit includes a dial (not shown) for visual indication of the number entered therein.

The means for measuring the length of the blanks 36 passing through the folder-gluer 10 is shown by the blocks labeled "electric eye" and "box length detector" and denoted by numerals 52 and 72 respectively. The electric eye 52 is of conventional design and has been previously described in connection with its location on the folder. However, an infra-red emitter and receiver or ultra-sonic emitter and receiver may be used in lieu of the photocell 52 and reflector 56 as previously described. The block 72 contains appropriate circuitry and components for producing a low level voltage electrical signal in output line 74 during the time that a blank 36 is interrupting the beam 60 shown in FIG. 1 along with the photocell 52 and reflector 56.

The block labeled "run detector" and denoted by numeral 76 may consist of simply a normally open relay that is closed when the box and folding machines are turned on to supply electrical energy in output line 78 to the control means that will be described. In this manner, the jam detection system will not operate when the machine is not running.

A normally closed relay denoted by numeral 80 is a conventional relay in an electrical supply line 82 leading to the start-stop circuit of the drive motor (not shown) for the box machine. When a jam-up is detected, a signal from the control circuit, to be described, causes relay 80 to open thereby stopping the drive motor. At the same time, a lamp 84 is turned on by the control circuit to provide a visual indication that the machine has stopped because of a jam-up, it being understood that the machine may stop or be stopped for other reasons.

The remaining blocks are all a part of the control circuit means shown enclosed within the dashed lines and generally denoted by numeral 86. The block labeled "length encoder" represents the shaft encoder 62 that is physically located on the end of drive shaft 32 as previously described. The encoder 62 rotates continuously, when the folder 10 is running, although the electrical signals it generates by virtue of such rotation are not used continuously as will be explained. The control circuit means 86 may best be explained in terms of its function as follows. Briefly, the control circuit 86 compares actual blank length to the length of the blanks 36 as measured during their passage through the folder 10. If the measured length is greater than the actual blank length, a jam-up is indicated and the machine is stopped. The measured blank length may be greater than the actual blank length if a blank interrupts the photocell beam 60 for too long a time; such interruption may be caused by the blank not advancing at machine speed (indicating an impending jam) or by one blank abutting or overlapping a preceding blank so that they are measured as one blank which indicates a jam. However, some deviation in measured length is acceptable since the blanks 36 may slip on the belts 28R and 28L so that they appear to be longer than they are or the blanks may skew slightly, without actually causing a jam. Such deviation may amount to about nine-tenths of an inch (22.8mm) without causing a jam. Therefore, the control means includes means for adding such an amount indirectly to the actual length for comparison to the measured length so that a jam is indicated only if the measured length exceeds the sum of the actual length plus the added amount.

The foregoing is accomplished by first entering the actual blank length into the circuitry of the block labeled "preset selected box length" and denoted by numeral 70. The actual length is entered in the form of digital signals, such as by turning the aforementioned thumbwheels. These digits remain fixed (unless changed to a different box size) in the selected length circuit 70 but are visible, through line 90, for comparison in a "box length comparator selected box length to detected box length" circuit 88.

The measured box length is provided by the electric eye 52 with its associated box length detector circuit 72, the length encoder 62 with an associated "pulse shaper" circuit 92, and a "detected box length accumulator" circuit 94. The accumulated digits in accumulator circuit 94 are visible, through line 96, for comparison to the digits in the selected length circuit 70 by the comparator 88. The electric eye 52 is incapable of measuring per se; it merely responds to interruption of its beam 60 by the leading edge of a blank 36 to supply a signal to box length detector 72 through the line 98. The detector 72 produces a low level of voltage in lines 74 and 100 to the accumulator circuit 94 so long as the beam 60 is interrupted by a blank 36 passing through it. Meanwhile, the encoder 62 is sending a constant supply of digital signals to the pulse shaper 92 through the line 102. The pulse shaper 92 contains appropriate components and circuitry to shape the digital signals from encoder 62 to equal the length of the incremental measurements of the box for registration in an up-counter in the accumulator 94, such shaped pulses entering accumulator 94 through line 104. However, the constant supply of shaped pulses from encoder 62 are not registered by the accumulator 94 until its circuitry is energized by the low level voltage input in line 100 from the electric eye 52. In this manner, shaped pulses are registered in the accumulator only when the beam 60 of electric eye 52 is interrupted by the passing blanks and thereby results in the accumulation of a number of pulses corresponding to the number of measured increments of box length. Thus, it can be seen that if a blank interrupts the beam 60 for too long a time or if two blanks are close enough (or overlapped to appear as one blank to the electric eye 52, then the number of accumulated pulses will exceed the number of digits stored in the selected box length circuit 70.

The accumulated pulses in the accumulator 94 are visible to the comparator 88 through line 96 as previously mentioned; the comparator 88 continuously compares the accumulating pulses in accumulator 94 to the fixed number of digits stored in the selected box length circuit 70. If the pulses from accumulator 94 reach the number of digits in the selected box length circuit 70, then the comparator 88 produces a pulse in line 106 to the "theoretical end of box memory" circuit 108. However, if the pulses from accumulator 94 received by the comparator 88 never reach the number of digits provided by the selected box length circuit 70, no pulse is produced in line 106 and the theoretical end of box memory circuit 108 remains in a steady state condition and the accumulator 94 will be reset to zero as will be explained. If a pulse does appear in line 106, then the theoretical end of box memory circuit 108 (which may be a convention flip-flop circuit) goes high thereby producing a high level of voltage in line 110 to a "skew or error accumulator" circuit 112 which is used to determine whether the measured length of the blank being measured exceeds the tolerable error. This is accomplished by accumulating the additional pulses (if still being produced) from the pulse shaper circuit 92 supplied through lines 104 and 114. The additional pulses are stored in an up-counter in the same manner as in accumulator 94. Any additional pulses are visible to a "skew or error comparator" circuit 116 through line 118 for comparison to tolerable error digits. The number of digits representing tolerable error are permanently entered into an "error preset" circuit 124 and are visible for comparison by the comparator 116 through line 126. The digits from the error preset circuit 124 are continuously compared to the number of additional measured length digits (if any) in the accumulator 112. If the number of additional digits reaches the number of tolerable digits, a pulse is generated in line 120 to a "jam indicator" circuit 122. At the same time, if the box length detector circuit 72 is still producing a logic level voltage in line 74, this voltage will be transmitted by lines 74 and 128 to the jam detector circuit 122. Thus, when this input is present and a pulse is received from the comparator 116 through line 120, the jam detector circuit 122 will produce a signal in line 82 to open the relay 80 stop the machine and produce a signal in line 130 to turn on the lamp 84 to indicate a jam condition. It should also be observed that the output from the run detector circuit 76 is fed by lines 78 and 132 to the jam indicator circuit 122. This input must also be present for the circuit 122 to produce the jam signals. If the machine is stopped, there is no input to the jam detector circuit 122 from the run detector circuit 76, thus, the machine may be jogged slowly by a conventional jog circuit (not shown and not connected to the control circuit 86) to clear the jam without the jam indicator circuit 122 stopping the machine.

It should be understood that the box length detector circuit 72 serves to reset the control circuit 86 after each blank 36 passes through the electric eye beam 60; that is, the trailing edge of each blank is detected by the electric eye 52 by resumption of the light beam 60 hitting the reflector 56. This causes the voltage in lines 74, 100, and 128 to go low; the accumulator circuits 94 and 112 are arranged to reset to zero when this occurs. Thus, the control circuit 86 is reset each time a blank passes the electric eye 52 if no jam-up has occurred. On the other hand, if a jam-up has occurred, the relay 80 will open thereby stopping the machine. The jam may be cleared by jogging the machine. The box length detector circuit 72 causes the voltage in lines 74, 100, and 128 to go low after the jam has been cleared thereby resetting the accumulators to zero. Thus, when the machine is restarted after a jam-up has been cleared, the accumulator 94 is already at zero and will await detection of the leading edge of the advancing blank 36 by the electric eye 52 before it begins accumulating pulses as previously described.

It should be recognized that the amount of preset error in circuit 124 is normally established when the folder 10 is built although the number of digits representing the tolerable error may be changed by circuit wiring changes or by providing a selector switch for such purpose or by an error preset constant in a computer. The preset selected box length is a variable number corresponding to the size of blank being run. Although it has been described as being entered by thumbwheel settings, it may be entered from a computer keyboard on a computer used to set up other functions of the machine such as folding rail spacing and the like. Similarly, the number may be entered from computer memory for the size of blanks that have been run before and stored in memory. In addition, the control circuit 86 and its associated components and circuits may be interfaced with other computer functions. Those skilled in the art will readily recognize how this can be done. The actual arrangement of the circuits of the pulse shaper, accumulators, comparators, and memory circuits is not critical; the only requirement is that they provide the functions as set forth above.

In summary, the present invention provides a method and apparatus for reliably indicating impending and jam-up conditions and stopping the advance of the blanks in such event. The system is flexible in that it does not depend on the spaces between the blanks being constant or that the length of the blanks be exactly constant and it permits continued advancement of the blanks even when slippage or skewing occurs which is not severe enough to cause a jam-up. In this respect, it constitutes considerable improvement over known jam detection systems.

Thus, the invention having been described in its best embodiment and mode of operation, that which is desired to be claimed by Letters Patent is:

1. A method of detecting jam-ups of serially advancing blanks comprising the steps of:
   - storing a number corresponding to the length of said blanks in predetermined increments;
   - detecting a leading edge of said advancing blanks;
   - actuating a control means in response to detecting said leading edges, said control means adapted to generate one digit corresponding to said predetermined increments;
   - detecting a trailing edge of said advancing blanks after actuating said control means;
   - deactuating said control means in response to detecting said trailing edges;
   - comparing said stored number to the number of digits generated by said control means during actuation thereof; and
   - stopping the advance of said blanks when the number of said digits exceeds said stored number.

2. The method of claim 1 wherein the steps of detecting said leading and trailing edges comprises the steps of:
   - directing a beam of energy into the path of advance of said blanks, said beam adapted for interruption by the passage of said leading edges and resumption by the passage of said trailing edges; and
   - generating a first signal in response to said interruption for actuating said control means and generating a second signal in response to said resumption for deactuating said control means.

3. The method of claim 2 wherein the step of actuating a control means comprises the steps of:
   - producing an encoder signal for each of said predetermined increments from a rotating shaft encoder means during actuation of said control means; and
   - advancing a counter means one digit for each of said encoder signals, said digits being adapted for comparison to said stored number.

4. Apparatus for detecting jam-ups of serially advancing blanks comprising:
   - storage means for storing a number corresponding to the length of said blanks in predetermined increments;
   - detection means for detecting leading and trailing edges of said advancing blanks;
   - control means responsive to detection of said leading edges for generating a digit corresponding to said predetermined increments, said control means being deactuated in response to detection of said trailing edges; and
   - comparison means for comparing said number stored in said storage means to the number of digits generated by said control means during actuation thereof, said comparison means operative for stopping the advance of said blanks when the number of digits exceeds said stored number.

5. The apparatus of claim 4 wherein said detection means includes:
   - an energy beam emitter means for directing a beam of energy into the path of advance of said blanks, said emitter means adapted for actuating said control means upon interruption of said beam by passage of the leading edges of said blanks and for deactuating said control means upon resumption of said beam by passage of the trailing edges of said blanks for maintaining actuation of said control means during passage of said blanks past said emitter means.

6. The apparatus of claim 5 wherein said control means includes:
   - a storage means for storing said number corresponding to the length of said blanks for predetermined increments; a rotatable shaft encoder means for providing an encoder signal for each of said predetermined increments during actuation thereof in response to interruption of said beam;
   - a counter means responsive to said encoder signals for providing a number of digits for comparison to said number stored in said storage means; and
   - an output signal means for stopping the advance of said blanks when the number of digits exceeds said stored number.

7. Apparatus for detecting jam-ups or serially advancing blanks comprising:
   - a number receiving means for receiving a number corresponding to the length of said blanks in predetermined increments;
   - a rotatable shaft encoder means for producing an encoder signal for each of said predetermined increments during actuation thereof;
   - a photocell means for directing a light beam into the path of advance of said blanks and producing a first signal upon interruption of said beam by the passage of leading edges of said blanks and a second signal upon resumption of said beam by the passage of trailing edges of said blanks; and
   - a control means including:

a storage means for storing first digits corresponding to said number received from said number receiving means;

an encoder circuit for actuating said encoder means to produce said encoder signals in response to said first signal from said photocell means and deactuating said encoder means to stop encoder signals in response to said second signal from said photocell means;

a first counter means for storing second digits for each of said encoder signals received from said encoder means;

a comparison circuit means for comparing the number of first digits in said storage means to the number of second digits in said first counter means; and a stop circuit means, operative when the number of said second digits exceeds the number of said first digits, for stopping the advance of said blanks.

8. The apparatus of claim 7 wherein said control means further includes:

a second counter means for storing a preselected number of third digits, said comparison circuit means adapted to add said third digits to said first digits and to initiate operation of said stop circuit means when the number of said second digits exceeds the sum of said first and third digits.

* * * * *